US011376841B2

(12) United States Patent
Umemoto et al.

(10) Patent No.: US 11,376,841 B2
(45) Date of Patent: Jul. 5, 2022

(54) INKJET IMAGE FORMING APPARATUS AND IMAGE QUALITY ADJUSTMENT METHOD

(71) Applicant: Konica Minolta Inc., Tokyo (JP)

(72) Inventors: Hiroaki Umemoto, Neyagawa (JP); Yukimasa Azuma, Machida (JP)

(73) Assignee: KONICA MINOLTA, INC., Tokyo (JP)

( * ) Notice: Subject to any disclaimer, the term of this patent is extended or adjusted under 35 U.S.C. 154(b) by 180 days.

(21) Appl. No.: 16/798,943

(22) Filed: Feb. 24, 2020

(65) Prior Publication Data

US 2020/0269564 A1 Aug. 27, 2020

(30) Foreign Application Priority Data

Feb. 26, 2019 (JP) ..... JP2019-032575

(51) Int. Cl.
*B41J 2/005* (2006.01)
*B41J 2/045* (2006.01)

(52) U.S. Cl.
CPC ..... *B41J 2/0057* (2013.01); *B41J 2/04571* (2013.01)

(58) Field of Classification Search
CPC ..... C09D 11/107; C09D 11/322; C09D 11/101; C09D 11/326; C09D 11/38; C09D 11/36; C09D 11/40; C09D 11/30; C09D 11/32; C09D 11/324; C09D 11/328; C09D 11/102; C09D 11/005; C09D 11/54; C09D 11/52; C09D 11/106; C09D 11/03; C09D 11/037; C09D 11/033; B41J 11/0021; B41J 2/2107; B41J 2/01; B41J 11/002; B41J 2/211; B41J 2/1433; B41J 2/17; B41J 2/17593; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 2/1623; B41J 2202/00; B41J 2202/03; B41J 2/14201; B41J 2/045; B41J 11/0015; B41J 2/04581; B41J 2/055; B41J 2/16538; B41J 2002/16502; B41J 29/02; B41J 2/17513; B41J 2/17509; B41J 29/13; B41J 2/17553; B41J 2/1606; B41J 2/1642; B41J 2/1609; B41J 2/164;
(Continued)

(56) References Cited

U.S. PATENT DOCUMENTS 6,318,853 B1 * 11/2001 Asano ..... B41J 2/0057 347/103
2003/0038871 A1 * 2/2003 Shinkoda ..... B41J 2/0057 347/103

(Continued)

FOREIGN PATENT DOCUMENTS

JP 2018122503 A 8/2018

*Primary Examiner* — Manish S Shah
(74) *Attorney, Agent, or Firm* — Cantor Colburn LLP

(57) ABSTRACT

An inkjet image forming apparatus, includes: a transfer part that transfers ink ejected from an inkjet head and carried on an intermediate transfer body to a recording medium; and a hardware processor that: detects a transfer rate when the ink is transferred by the transfer part; and controls a control parameter that influences how the ink spreads when being transferred to the recording medium, according to the transfer rate detected by the hardware processor.

14 Claims, 6 Drawing Sheets

(58) Field of Classification Search
CPC ..... B41J 2/162; B41J 2/161; B41J 2/19; B41J 15/04; B41J 25/001; B41J 25/34; B41J 25/003; B41J 25/312; B41J 2025/008; B41J 2202/21; B41J 2/17596; B41J 2/16508; B41J 2/1652; B41J 2/175; B41J 2/17563; B41M 5/0023; B41M 7/0081; B41M 3/006; B41M 3/003; B41M 5/0011; B41M 5/0017; B41M 5/0047; B41M 7/00; B41M 7/0072; B41M 5/52; B41M 5/5218; B41M 5/5227; G02B 5/20; G02B 5/223; C08K 3/11; C08K 2003/2237
See application file for complete search history.

(56) References Cited

U.S. PATENT DOCUMENTS

2004/0246318 A1* 12/2004 Askren ..... B41J 11/0015 347/96
2005/0074618 A1* 4/2005 King ..... B41J 2/0057 428/447
2006/0012625 A1* 1/2006 Huang ..... B41J 29/393 347/19
2008/0170266 A1* 7/2008 Takahashi ..... H04N 1/40087 358/3.1
2018/0215141 A1* 8/2018 Morita ..... B41J 2/0057

* cited by examiner

INKJET IMAGE FORMING APPARATUS AND IMAGE QUALITY ADJUSTMENT METHOD

CROSS REFERENCE TO RELATED APPLICATIONS

The present invention claims priority under 35 U.S.C. § 119 to Japanese Patent Application No. 2019-032575, filed on Feb. 26, 2019, is incorporated herein by reference in its entirety.

BACKGROUND

Technological Field

The present invention relates to an inkjet image forming apparatus and an image quality adjustment method.

Description of the Related Art

In recent years, as apparatuses for recording high-definition images on various recording media such as paper and cloth, image forming apparatuses using an inkjet method (hereinafter referred to as inkjet image forming apparatuses) have been widely used.

In recent years, to reduce cost, it has been required of the inkjet image forming apparatuses to reduce the amount of ink ejected from inkjet heads and thus the amount of ink adhering to a recording medium as much as possible. However, reducing the amount of adhesion of ink causes a problem that the contrast ratio decreases in solid image printing, causing inconsistencies in solidness.

For this problem, if spherical droplets ejected from the inkjet heads can be flattened (spread) on the recording medium, the decrease in the contrast ratio can be eliminated. On the other hand, using such a method may cause ink bleed on the recording medium, depending on the ink viscosity (particularly when the ink viscosity is low).

In order to address the above problems, there has been proposed an intermediate transfer-type inkjet image forming apparatus in which an image formed by ink ejected from inkjet heads is temporarily carried on an intermediate transfer body such as an intermediate transfer belt, and the image is transferred to a recording medium (see JP 2018-122503 A, for example).

In general, the intermediate transfer-type inkjet image forming apparatus forms ink dots (an image) on the intermediate transfer body, and irradiates the intermediate transfer body with active energy rays such as UV to perform an ink pre-curing (thickening) process, and then performs a process to transfer the image to a recording medium (such as paper) by a transfer nip. Thus, the intermediate transfer-type apparatus varies in transfer state, depending on the state of the intermediate transfer body, the cured state of the ink, the type of recording medium, and transfer conditions (such as a transfer pressure). In particular, a change in transfer efficiency causes a problem such as an increase in loss due to the occurrence of residual ink after transfer or variations in image density.

For this problem, the technique described in JP 2018-122503 A employs a configuration to adjust the amount of application of a transferability improvement liquid to the intermediate transfer body, according to the amount of residual ink after transfer. However, the technique described in JP 2018-122503 A has a problem of increased cost because it applies the transferability improvement liquid.

SUMMARY

It is an object of the present invention to provide an inkjet image forming apparatus and an image quality adjustment method that can reduce an increase in cost while maintaining high transfer efficiency.

To achieve the abovementioned object, according to an aspect of the present invention, an inkjet image forming apparatus reflecting one aspect of the present invention comprises: a transfer part that transfers ink ejected from an inkjet head and carried on an intermediate transfer body to a recording medium; and a hardware processor that: detects a transfer rate when the ink is transferred by the transfer part; and controls a control parameter that influences how the ink spreads when being transferred to the recording medium, according to the transfer rate detected by the hardware processor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
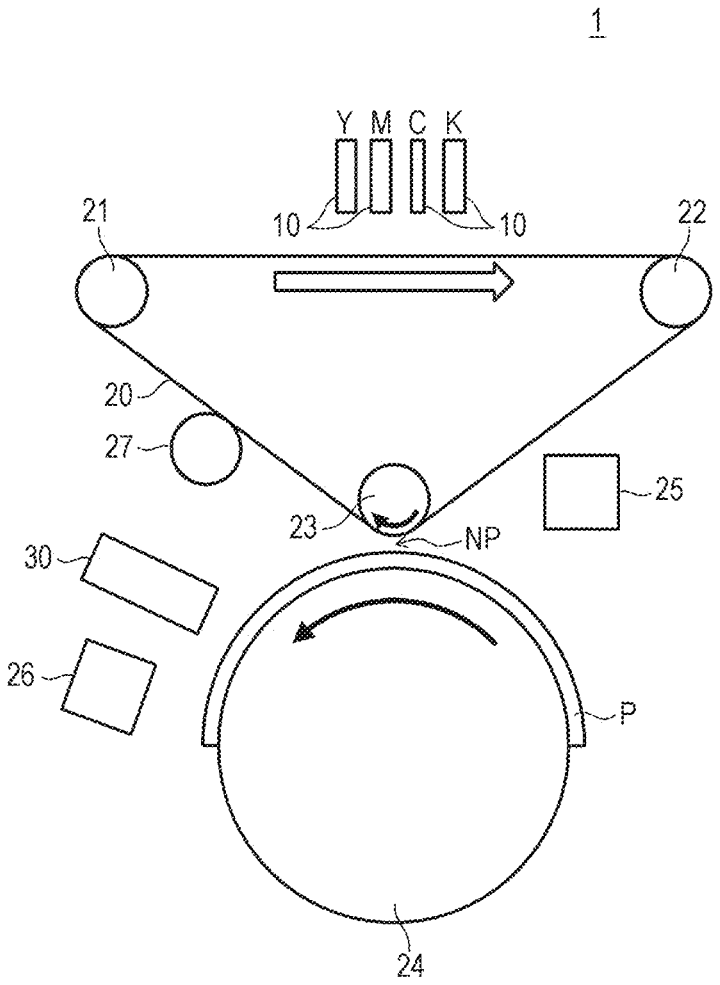
FIG. 1 is a schematic configuration diagram of an inkjet image forming apparatus in the present embodiment.
Figure 2:
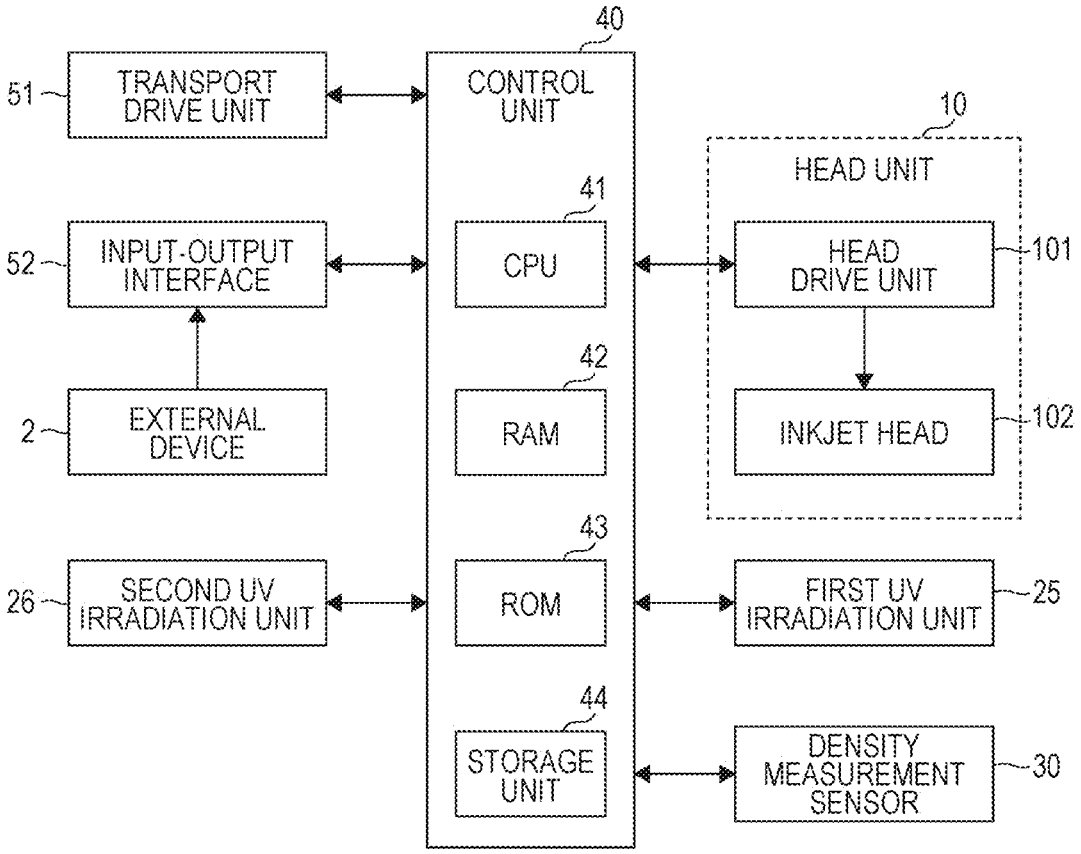
FIG. 2 is a block diagram showing the major functional configuration of the inkjet image forming apparatus in FIG. 1.

Hereinafter, an inkjet image forming apparatus according to one or more embodiments of the present invention will be described in detail with reference to the drawings. However, the scope of the invention is not limited to the disclosed embodiments. FIG. 1 is a diagram showing the schematic configuration of an inkjet image forming apparatus 1 according to the present embodiment. FIG. 2 is a block diagram showing the major functional configuration of the inkjet image forming apparatus 1.

The inkjet image forming apparatus 1 includes head units 10 each equipped with an inkjet head 102 (see FIG. 2), a transfer belt 20 as an image carrier or an intermediate transfer body, driven rollers 21 and 22 and a transfer roller 23 as a drive roller between which the transfer belt 20 is rotatably stretched, a transport drum 24 that transports a recording medium P, and a control unit 40 that controls the entire apparatus (see FIG. 2).

The inkjet image forming apparatus 1 further includes a first UV irradiation unit 25 that adjusts the viscosity of ink ejected to the transfer belt 20, a second UV irradiation unit 26 that cures the ink transferred to the recording medium P, a cleaning unit 27 that cleans the transfer belt 20, a density measurement sensor 30, and a transport drive unit 51 that drives parts such as the transfer roller 23 and the transport drum 24 (see FIG. 2). Among those described above, the first UV irradiation unit 25 corresponds to a "viscosity adjuster" of the present invention. The density measurement sensor 30 and the control unit 40 correspond to a "transfer rate detection unit" of the present invention.

Although not shown, the inkjet image forming apparatus 1 includes a feed unit that carries and feeds the recording medium P to the transport drum 24, an output unit that outputs the recording medium P to which an image has been transferred downstream in a transport direction of the transport drum 24, a display unit that displays the status of the apparatus, etc. These have known configurations, and thus are not shown and will not be described. As the recording medium P, in addition to paper such as plain paper and coated paper, various media that allow ink landed on a surface to be fixed into place, including cloth and sheet-shaped resin, can be used.

The transfer belt 20 is stretched between the driven rollers 21 and 22 disposed above and the transfer roller 23 disposed below, and rotates in a clockwise direction in FIG. 1 by a driving force of a transfer motor (not shown) of the transport drive unit 51 being transmitted to the transfer roller 23. As one specific example, for the transfer belt 20, an endless belt is used in which an elastic layer of silicon rubber, a reflective layer on which aluminum (Al) is vapor-deposited, and a surface layer of polypropylene (PP) are stacked on a substrate of polyimide (PI). As one specific example of the transfer roller 23, a rubber roller having a diameter of 100 mm and a surface layer rubber thickness of 10 mm is used.

In the inkjet image forming apparatus 1, the transfer belt 20 is rotated in the clockwise direction in FIG. 1 by the transfer motor being driven based on a control signal of the control unit 40 and the transfer roller 23 rotating in the clockwise direction (see arrows in the figure). In one specific example, under the control of the control unit 40, the rotation speed of the transfer roller 23 is controlled such that the transfer belt 20 rotates at a speed of 600 mm/second (printing speed).

The transport drum 24 rotates about a rotation axis extending in a direction perpendicular to the drawing in FIG. 1 (hereinafter referred to as an "orthogonal direction") while holding the recording medium P on its outer peripheral curved surface in a cylindrical surface shape (transport surface), thereby transporting the recording medium P in the transport direction along the transport surface. Specifically, the transport drum 24 includes a transport drum motor (not shown), and rotates in a counterclockwise direction in FIG. 1 by the motor being driven under the control of the control unit 40. In one specific example, for the transport drum 24, a large (e.g., a triple size cylinder for a printing press) metal drum is used.

In one specific example, the transfer belt 20 and the transport drum 24 described above have a width or an axial length of 800 mm.

The transfer roller 23 is disposed opposite the top of the transport drum 24, and pressurizes the transport drum 24 with the transfer belt 20 therebetween. By the transport drum 24 being pressed against the transfer roller 23 with the transfer belt 20 therebetween, a transfer nip NP that transfers an ink image from the transfer belt 20 to the recording medium P is formed. The transfer nip NP corresponds to a "transfer part" of the present invention.

In one specific example, the initial value of weight or pressure contact force (hereinafter referred to as "transfer pressure") at the transfer nip NP is set to 80 N. The transfer pressure can be changed by the transfer roller 23 slightly moving in a vertical direction in FIG. 1 under the control of the control unit 40. In one specific example, a shaft of the transfer roller 23 is connected to a solenoid or the like (not shown) of the transport drive unit 51, and the solenoid or the like is driven under the control of the control unit 40, so that the shaft of the transfer roller 23 slightly moves in a downward or upward direction in FIG. 1 and can change the transfer pressure to a value higher or lower than 80 N. The solenoid or the like corresponds to a "transfer pressure adjuster" of the present invention.

The head units 10 each eject ink from nozzle openings provided in an ink ejection surface facing the transfer belt 20 to the transfer belt 20 to cause the transfer belt 20 to carry an image. The transport drum 24 transports the recording medium P such that the image carried on the transfer belt 20 is transferred to a predetermined position of the recording medium P by the transfer nip NP.

In the inkjet image forming apparatus 1 in the present embodiment, four head units 10 corresponding one-to-one to ink of four colors of yellow (Y), magenta (M), cyan (C), and black (K) are aligned at predetermined intervals in the order of the colors of Y, M, C, and K from the upstream side in a rotation direction of the transfer belt 20.

Each head unit 10 includes an inkjet head 102 (see FIG. 2). The inkjet head 102 is provided with a plurality of recording elements each including a pressure chamber for storing ink, a piezoelectric element provided at a wall surface of the pressure chamber, and a nozzle. When a drive signal for deforming the piezoelectric element is input to the recording element, the pressure chamber is deformed by the deformation of the piezoelectric element, changing the pressure in the pressure chamber, so that the ink is ejected from the nozzle communicating with the pressure chamber.

The disposed range of the nozzles included in the inkjet head 102 in the orthogonal direction covers the width in the orthogonal direction of an area on which an image is recorded of the recording medium P transported by the transport drum 24. The head units 10 are used in positions fixed with respect to the rotation axis of the transport drum 24 at the time of image recording. That is, the inkjet image forming apparatus 1 is a single-pass inkjet image forming apparatus.

In the present embodiment, as ink to be ejected from the inkjet heads 102 to the transfer belt 20, ink whose viscosity changes according to the amount of energy supplied to the transfer belt 20 (in this example, the amount of ultraviolet (UV) light output from the first UV irradiation unit 25) is used. Specifically, ink whose viscosity increases as the amount of ultraviolet light applied from the first UV irradiation unit 25 increases is used. That is, an image forming section of the inkjet image forming apparatus 1 employs a UV cure inkjet method.

The first UV irradiation unit 25 is disposed to irradiate the transfer belt 20 on the upstream side of the transfer nip NP with ultraviolet rays (hereinafter referred to as "UV light"), and plays a role in pre-curing ink that has adhered to the transfer belt 20 under the control of the control unit 40. In one specific example, the first UV irradiation unit 25 includes a UV light source that outputs UV light having a wavelength of 395 nm, and the default value of irradiation intensity in a normal print job is set to 1.5 $mW/cm^2$.

The second UV irradiation unit 26 is disposed to irradiate the recording medium P transported downstream of the transfer nip NP with UV light, and plays a role in fully curing the ink that has been pre-cured by the first UV irradiation unit 25 and transferred by the transfer nip NP, under the control of the control unit 40. In one specific example, the second UV irradiation unit 26 includes a UV light source that outputs UV light having a wavelength of 395 nm, and the default value of irradiation intensity in a normal print job is set to 5 $mW/cm^2$.

The cleaning unit 27 is disposed opposite the surface of the transfer belt 20 between the driven roller 21 and the transfer roller 23, and includes a dry web that cleans the surface of the transfer belt 20. The dry web of the cleaning unit 27 can be brought into contact with and separated from the transfer belt 20, and is brought into contact with the transfer belt 20 under the control of the control unit 40 to remove residual ink and others on the surface of the transfer belt 20.

The density measurement sensor 30 measures the density of a transferred ink image on the recording medium P that has passed through the transfer nip NP, and outputs the value of the measured density to the control unit 40. As an example of the density measurement sensor 30, a filter-type densitometer can be used which irradiates the recording medium P with light and measures reflected light (reflected light intensity) through red, green, and blue filters. As another example of the density measurement sensor 30, a spectral-type densitometer can be used which irradiates the recording medium P with light, divides the wavelength of reflected light finely every 1 to 10 nm or so, and measures the intensity of the reflected light of each wavelength.

Next, the other major functional configuration of the inkjet image forming apparatus 1 will be described mainly with reference to FIG. 2. The inkjet image forming apparatus 1 includes the head drive unit 101 and the inkjet head 102 included in each head unit 10, the control unit 40, the transport drive unit 51, and an input-output interface 52.

The head drive unit 101 outputs drive signals for deforming the piezoelectric elements according to image data at proper timings to the recording elements of the inkjet head 102, based on the control of the control unit 40, thereby causing amounts of ink corresponding to the pixel values of the image data to be ejected from the nozzles of the inkjet head 102.

The control unit 40 includes a central processing unit (CPU) 41, random-access memory (RAM) 42, read-only memory (ROM) 43, and a storage unit 44.

The CPU 41 reads various control programs and setting data stored in the ROM 43, stores them in the RAM 42, and executes the programs for various kinds of arithmetic processing. The CPU 41 performs centralized control of the entire operation of the inkjet image forming apparatus 1.

The RAM 42 provides a memory space for work to the CPU 41, and stores temporary data. The RAM 42 may include nonvolatile memory.

The ROM 43 stores the various control programs executed by the CPU 41, the setting data, etc. Instead of the ROM 43, a rewritable nonvolatile memory such as an electrically erasable programmable read-only memory (EEPROM) or a flash memory may be used.

The storage unit 44 stores a print job (an image formation instruction including various kinds of user setting information such as the number of sheets to be printed) input from an external device 2 via the input-output interface 52 and image data related to the print job. As the storage unit 44, for example, a hard disk drive (HDD) is used, and dynamic random access memory (DRAM) or the like may be used in combination.

The transport drive unit 51 provides a drive signal to the transport drum motor of the transport drum 24 based on a control signal provided from the control unit 40, to rotate the transport drum 24 at a predetermined speed and timing. The transport drive unit 51 provides a drive signal to the motor of the transfer roller 23 based on a control signal provided from the control unit 40, to rotate the transfer belt 20 at a predetermined speed and timing.

The input-output interface 52 mediates data transmission and reception between the external device 2 and the control unit 40. The input-output interface 52 is formed, for example, by one of various serial interfaces and various parallel interfaces, or a combination thereof.

The external device 2 is, for example, a personal computer, and provides a print job, image data, etc. to the control unit 40 via the input-output interface 52.

Figure 3:
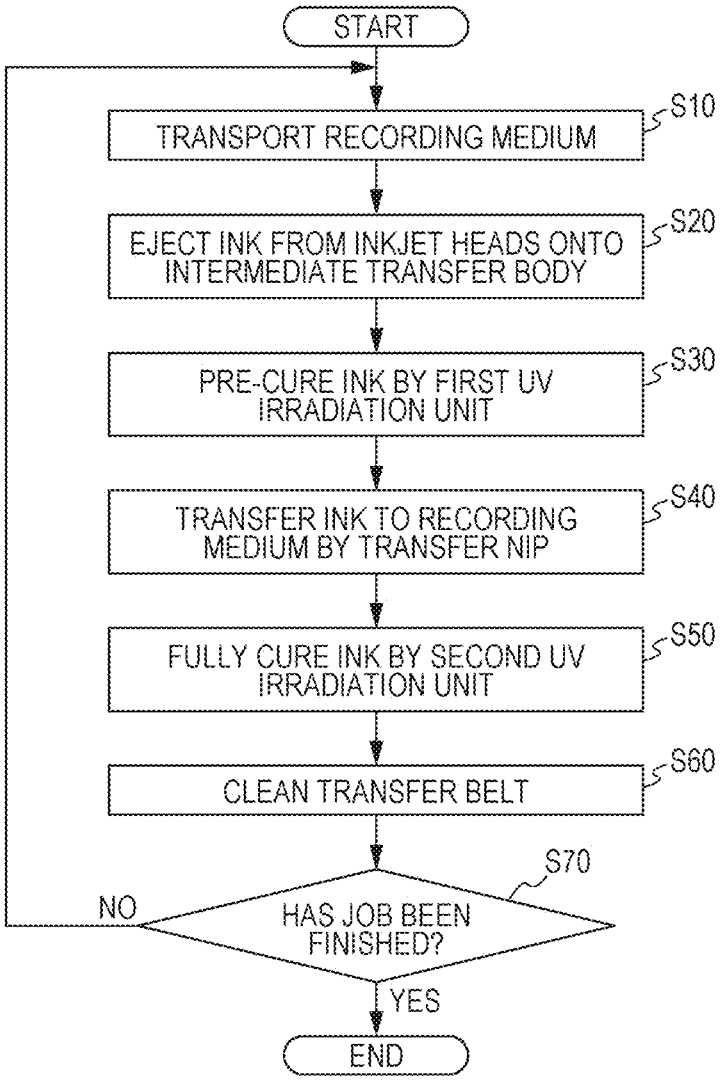
FIG. 3 is a flowchart for explaining processing when a normal print job is executed.

Next, with reference to the flowchart in FIG. 3, processing executed by the control unit 40 when a normal print job is executed will be described.

In step S10 after receiving a print job, image data, etc., the control unit 40 controls the transport drive unit 51 to drive the transport drum 24 and the transfer roller 23 to start to transport the recording medium P.

In step S20, the control unit 40 controls the head drive unit(s) 101 based on the received image data and the user setting information, to eject ink from the inkjet head(s) 102 of the head unit(s) 10 of a color(s) used in the printing (image formation) onto the transfer belt 20 (intermediate transfer body). By this operation, an image (ink image) based on the input image data is attached to or formed (carried) on the transfer belt 20.

In step S30, the control unit 40 controls the output (UV light amount) of the first UV irradiation unit 25 to the above-described intensity at the timing when the ink image on the transfer belt 20 comes to the position of the first UV irradiation unit 25, to perform an ink image pre-curing process.

In step S40, the control unit 40 controls the transport drive unit 51 to transport the recording medium P to the transfer nip NP at a predetermined timing, to transfer the ink image pre-cured on the transfer belt 20 to the recording medium P. At this time, the ink image is pressed at a preset transfer pressure (pinched by the transfer nip NP), so that the ink image pre-cured on the transfer belt 20 is transferred to the recording medium P, spreading in whole according to the ink density after the pre-curing, the transfer pressure, etc.

In step S50, the control unit 40 controls the output of the second UV irradiation unit 26 at the timing when the recording medium P to which the ink image has been transferred comes to the position of the second UV irradiation unit 26, to perform an ink image full-curing process. Thereafter, the recording medium P is output to an output unit (not shown).

In step S60, the control unit 40 outputs a drive signal to the cleaning unit 27, to perform a process of cleaning residual ink and others on the transfer belt 20.

In step S70, the control unit 40 determines whether the print job has been finished. Here, if the control unit 40 determines that the print job has not yet been finished (step S70, NO), the control unit 40 returns to step S10 to repeatedly execute the processing in steps S10 to S70 described above. On the other hand, if the control unit 40 determines that the print job has been finished (step S70, YES), the series of steps is completed.

Thus, the intermediate transfer-type inkjet image forming apparatus can spread ink smoothly on the recording medium P without bleeding while reducing the amount of ink liquid ejected from the inkjet heads 102, and thus has the advantage of being able to save ink.

On the other hand, the intermediate transfer-type inkjet image forming apparatus needs the pre-curing process for increasing the viscosity of an ink image on the transfer belt 20 by the viscosity adjuster (the first UV irradiation unit 25 in this example) before the recording medium P passes through the transfer nip NP, depending on the type of ink used or the like.

That is, an attempt to transfer an ink image on the transfer belt 20 to the recording medium P by the transfer nip NP without increasing its viscosity has a problem that the ink may be crushed by the pressing force of the transfer nip NP (spread too much on the recording medium P), depending on the type of ink or the like. Therefore, the inkjet image forming apparatus 1 of the present embodiment also increases (thickens) to some extent the viscosity of an ink image on the transfer belt 20 by irradiation with UV light from the first UV irradiation unit 25 before the ink image is transferred by the transfer nip NP.

On the other hand, in the pre-curing process, the transfer state varies, depending on printing environment (such as the state of the transfer belt 20, the cured state of ink, the type of recording medium P, and transfer conditions such as the transfer pressure). In particular, a decrease in transfer efficiency (transfer rate) at the transfer nip NP causes problems that the loss of ink increases due to the occurrence of residual ink after transfer, and further the image quality deteriorates due to variations in image density, and so on.

For these problems, as described above, there is a known technique of adjusting the amount of application of a transferability improvement liquid to the transfer belt 20 according to the amount of residual ink after transfer. However, this technique has a problem of increased cost because it applies the transferability improvement liquid.

By contrast, in the present embodiment, the transfer rate when ink is transferred by the transfer nip NP (transfer part) is detected, and the control unit 40 controls a control parameter that influences how the ink spreads when being transferred to the recording medium P, according to the detected transfer rate, to reduce an increase in cost while maintaining high transfer efficiency. The following describes the findings of the present inventors, the principle of the solution in the present invention, etc.

As described above, the intermediate transfer-type inkjet image forming apparatus 1 including the transfer belt 20 performs the pre-curing process to irradiate an ink image on the transfer belt 20 with UV light from the first UV irradiation unit 25 before transfer to increase the ink viscosity. It has been found that if the viscosity of ink dots is too low (i.e., if the degree of ink thickening is insufficient) in the pre-curing process, the internal cohesive force of the ink is weak, and the ink dots may break when transferred by the transfer nip NP, resulting in a decrease in transfer rate. On the other hand, it has been found that if the viscosity of ink dots is too high (if the ink is thickened excessively) in the pre-curing process, adhesion to the recording medium P (such as paper) decreases, so that the transfer rate also decreases.

On the other hand, as for the transfer pressure of the transfer nip NP when the irradiation intensity of UV light output from the first UV irradiation unit 25 is set to the above-described default value, the following findings have been obtained. It has been found that if the viscosity of ink dots increased by UV light applied from the first UV irradiation unit 25 is slightly high due to various changes in printing environment or the like, setting the transfer pressure of the transfer nip NP higher may be able to prevent or reduce a decrease in the transfer rate. It has also been found that if the viscosity of ink dots increased by UV light applied from the first UV irradiation unit 25 is slightly low, setting the transfer pressure of the transfer nip NP lower may be able to prevent or reduce a decrease in the transfer rate. However, it has been found as described above that if the viscosity of ink dots increased by UV light applied is too high or too low, it is not possible to reduce a decrease in the transfer rate even if the transfer pressure of the transfer nip NP is adjusted.

Therefore, to improve the rate of transfer to the recording medium P at the transfer nip NP, it is important to make the viscosity of an ink image when transferred by the transfer nip NP appropriate mainly by controlling the amount of UV light applied from the first UV irradiation unit 25. In particular, considering the occurrence of various errors in the inkjet image forming apparatus 1 (such as deterioration of the UV light source of the first UV irradiation unit 25 and changes in ink temperature at the time of ejection), differences in the ink absorbency of recording media P, etc., we have come to obtain the findings that it is very important to optimize the ink viscosity (thickened state) at the time of transfer by appropriately controlling the amount of UV light applied from the first UV irradiation unit 25. It has also been found that the suitability of the transfer rate of an ink image at the transfer nip NP, the appropriate range of ink viscosity, etc. can be determined by measuring the density of the ink image transferred by the transfer nip NP.

In view of these findings, in the present embodiment, as shown in FIG. 1, the density measurement sensor 30 is provided which measures the density of an ink image transferred by the transfer nip NP. The control unit 40 estimates (detects) the transfer rate at the transfer nip NP from a measurement value of the density measurement sensor 30 (i.e., the density of an ink image), and in accordance with the detection result, performs control to adjust the viscosity or dot state (the transfer pressure as a transfer condition) of ink to be transferred to a recording medium P (second recording medium) to be printed next so that the density of an ink image transferred thereafter and thus the transfer rate meet a predetermined standard (i.e., exceed a threshold value).

In the present embodiment, the control unit 40 estimates (detects) the transfer rate of an ink image after being ejected (carried) on the transfer belt 20 and pressed by the transfer nip NP (that is, spread on the recording medium P), based on a detection result of the density measurement sensor 30. In the example shown in FIG. 1, an object detected by the density measurement sensor 30 is the density of ink on the recording medium P (first recording medium) to which an image has been transferred by being pressed by the transfer nip NP. A configuration example in which the density measurement sensor 30 detects a different object will be described later.

In the present embodiment, the control unit 40 performs control to adjust the viscosity or dot state of ink to be transferred to the recording medium P (second recording medium) to be printed next according to the result of detection by the density measurement sensor 30 (the ink density) so that the transfer rate of the ink to be transferred to the recording medium P (second recording medium) to be printed next exceeds the threshold value. That is, the control unit 40 controls the output (UV light amount) of the first UV irradiation unit 25 or the transfer pressure of the transfer nip NP as a control parameter that influences how ink spreads when being transferred to the recording medium P such that the transfer rate of ink to be transferred to the recording medium P (second recording medium) to be printed next meets the predetermined standard.

Figure 4:
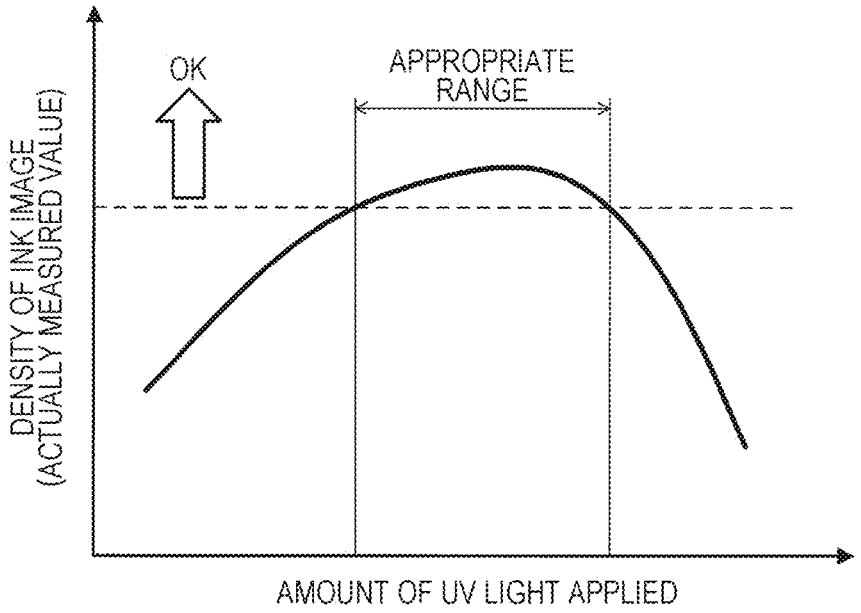
FIG. 4 is a characteristic graph showing the relationship between the amount of UV irradiation light before transfer and the density of an ink image detected after the transfer.

FIG. 4 shows in graph form the relationship between the mount of UV light applied by the first UV irradiation unit 25 before transfer and the density of an ink image after passing through the transfer nip NP measured (actually measured) by the density measurement sensor 30. In the characteristic graph of FIG. 4, the horizontal axis represents the amount of UV light applied from the first UV irradiation unit 25 to an ink image (a solid image in this example) on the transfer belt 20, and the vertical axis represents the density of the solid image on the recording medium P (paper) after passing through the transfer nip NP, actually measured by the density measurement sensor 30. A dotted line indicates a density value as a boundary value or a threshold value as to whether the transfer rate satisfies a standard value at the density of the solid image actually measured by the density measurement sensor 30.

As shown in FIG. 4, in order for the transfer rate to satisfy the standard value (exceed the threshold value), the amount of UV light applied from the first UV irradiation unit 25 needs to be adjusted so that the value of the ink image density actually measured by the density measurement sensor 30 increases to near a peak point. Here, it has been found that the actually measured value of the ink image density and the transfer rate are in a substantially proportional relationship, and when the former reaches the peak point, the transfer rate is the highest (best). On the other hand, it can be seen that the amount (appropriate range) of UV light from the first UV irradiation unit 25 at which the transfer rate satisfies the standard value has some width or margin.

Therefore, the present embodiment appropriately combines the adjustment of the UV light amount and the adjustment of the transfer pressure so that the value (density) actually measured by the density measurement sensor 30 becomes high, to be able to improve image quality and achieve image quality suitable for a user's purpose or the like while maintaining a high transfer rate.

Although not shown, it is considered that by changing the transfer pressure of the transfer nip NP, the dot state of an ink image (how it spreads) is changed, and the transfer rate is changed also by the change in the dot state, and further, the transfer pressure also has an optimum value or an appropriate range depending on conditions of the apparatus. Thus, if the UV light amount of the first UV irradiation unit 25 and the transfer pressure of the transfer nip NP are not accurately controlled, an ink image formed on the transfer belt 20 cannot be transferred to the recording medium P with high efficiency by the transfer nip NP, and a decrease in the transfer rate may deteriorate the image quality. Generally, in order for the intermediate transfer-type inkjet image forming apparatus 1 to ensure the transfer rate at the transfer nip NP and thus image reproducibility, both the adjustment of the transfer pressure when an ink image is transferred to the recording medium P by the transfer nip NP, and the adjustment of the ink viscosity in the previous stage are important.

On the other hand, in the inkjet image forming apparatus 1, various factors, errors, etc. that may affect the transfer of an ink image may occur as described above, and it is difficult to detect or obtain all information on the factors, errors, etc. by the control unit 40.

Therefore, in the present embodiment, the control unit 40 executes "transfer efficiency measurement mode" processing described below at a timing different from that when a normal print job is executed described above in FIG. 3. If the setting of the output (UV light amount) of the first UV irradiation unit 25 or the transfer pressure of the transfer nip NP is changed in this processing, a setting value after the change is applied to subsequent print jobs for execution. The outline of the processing in the transfer efficiency measurement mode is as follows.

In the transfer efficiency measurement mode, the control unit 40 causes ink to be ejected from the inkjet heads 102 to form test pattern ink images (hereinafter referred to as patch images) on the transfer belt 20. The control unit 40 changes the output (UV light amount) of the first UV irradiation unit 25 in stages to set the viscosity of the ink constituting the patch images on the transfer belt 20 to a plurality of states, in other words, to increase (or decrease) the viscosity of the ink of the patch images in stages.

Figure 5:
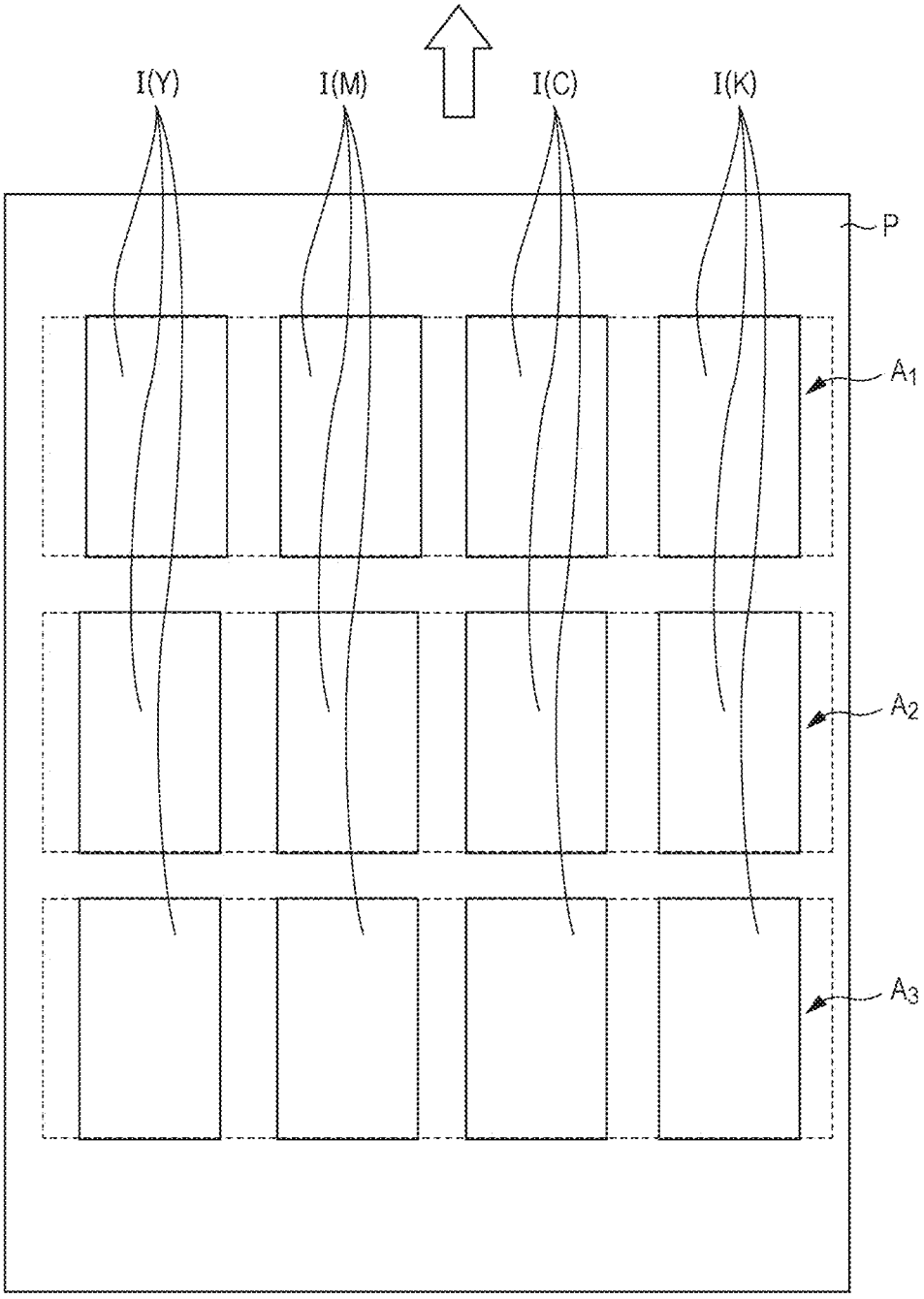
FIG. 5 is a diagram for explaining an example of patch images printed on a sheet of paper and a UV irradiation condition.

FIG. 5 shows one specific example of the patch images formed in the transfer efficiency measurement mode. FIG. 5 shows a state after they are transferred from the transfer belt 20 onto the recording medium P (paper). In this example, solid images I of the same shape (rectangular shape) formed by monochromatic ink are aligned in the order of Y, M, C, and K from the left side in a width direction orthogonal to the transport direction of the recording medium P (see an arrow in FIG. 5). The solid images I of each color (Y, M, C, and K; hereinafter simply referred to as patch images I) are aligned (in three rows in this example) along the transport direction. In the example shown in FIG. 5, for the patch images I in the first stage corresponding to an irradiation area $A_1$ enclosed by a dotted line, the amount of UV light applied from the first UV irradiation unit 25 is set low, for the patch images I in the second stage corresponding to an irradiation area $A_2$, the amount of UV light applied from the first UV irradiation unit 25 is set medium, and for the patch images I in the third stage corresponding to an irradiation area $A_3$, the amount of UV light applied from the first UV irradiation unit 25 is set high. This setting can increase the ink viscosity of the patch images I in stages in the order of the irradiation areas $A_1$, $A_2$, and $A_3$. Alternatively, the amount of UV light applied from the first UV irradiation unit 25 may be set conversely, that is, such that the ink viscosity of the patch images I is reduced in stages in the order of the irradiation areas $A_1$, $A_2$, and $A_3$.

Thereafter, from the results of measurement of the density measurement sensor 30, the control unit 40 determines the ink density on the recording medium P to which the patch images I have been transferred and thus the transfer rate, for each of the irradiation areas $A_1$, $A_2$, and $A_3$. Here, if the determined transfer rates in all of the irradiation areas $A_1$, $A_2$, and $A_3$ do not meet the predetermined standard (see the dotted line and the "appropriate range" in FIG. 4), the control unit 40 changes the setting of the output (UV light amount) of the first UV irradiation unit 25 or the transfer pressure of the transfer nip NP until the transfer rate of at least one of the irradiation areas $A_1$, $A_2$, and $A_3$ meets the standard, and repeats the formation, transfer, and measurement of the patch images I described above using the changed setting. If the determined transfer rates meet the predetermined standard, the control unit 40 sets the setting values of the output (UV light amount) of the first UV irradiation unit 25 and the transfer pressure of the transfer nip NP (parameters) at which the standard is met as printing conditions when subsequent print jobs are executed.

In the present embodiment, this control allows printing with high transfer efficiency at the time of print job execution.

Figure 6:
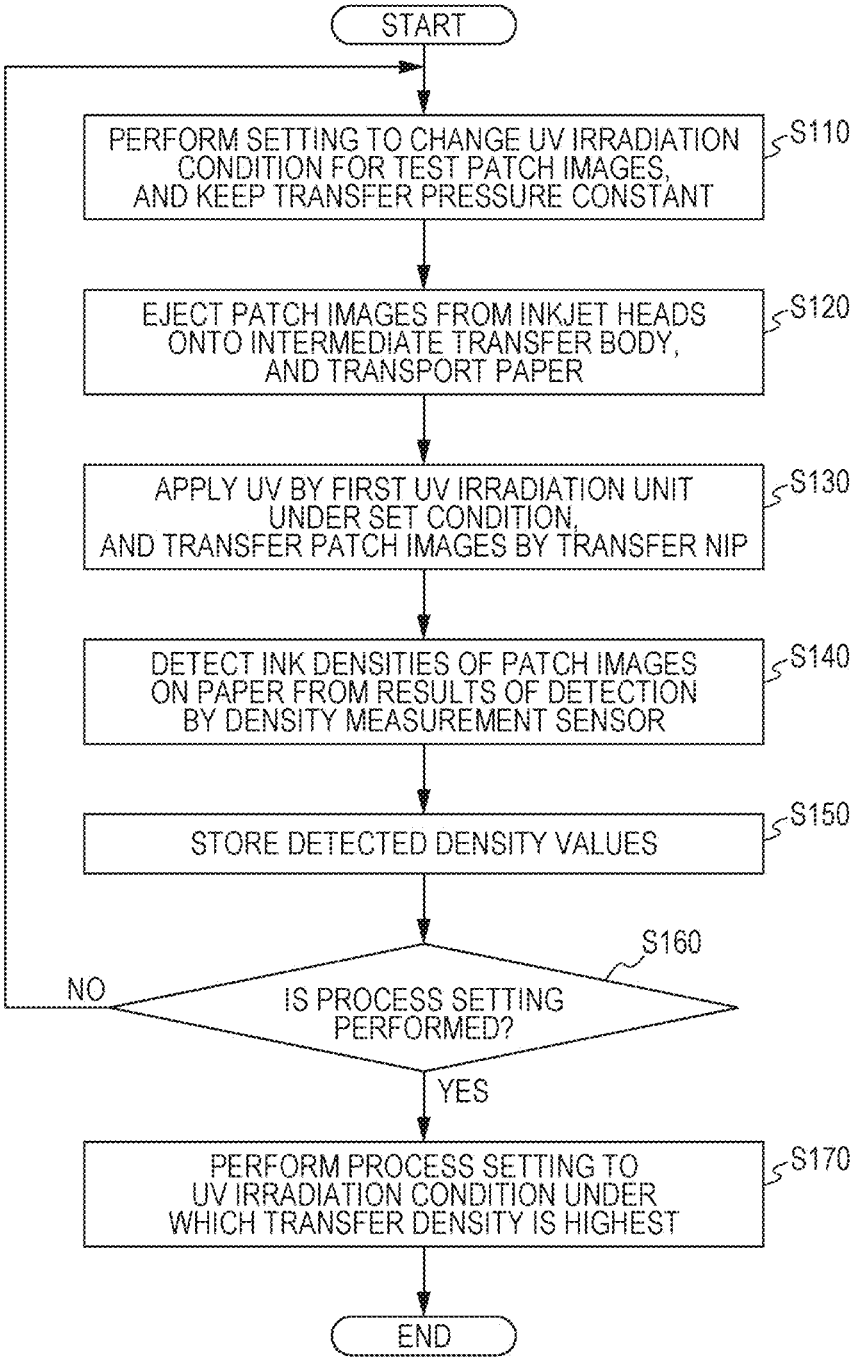
FIG. 6 is a flowchart showing an example of processing related to image quality adjustment.

Next, an example of the processing executed by the control unit 40 in the above-described transfer efficiency measurement mode will be described with reference to the flowchart shown in FIG. 6. The flowchart shown in FIG. 6 is executed by a user selecting a switch (not shown) for shifting to the transfer efficiency measurement mode after the end of a normal print job, at the start of the apparatus, or at the time of performance of maintenance, for example.

In step S110 after shifting to the transfer efficiency measurement mode, the control unit 40 performs setting to change the UV irradiation condition (output) by the first UV irradiation unit 25 for the test patch images I described above in FIG. 5 from one output area to another (of the UV light irradiation areas $A_1$ to $A_3$ in this example), and to keep the transfer pressure of the transfer nip NP constant. In this example, the control unit 40 sets the UV irradiation condition (output parameter) by the first UV irradiation unit 25 in such a manner that the UV output is set low in the irradiation area $A_1$ corresponding to an upstream part of the patch images I (see FIG. 5), the UV output is set medium in the irradiation area $A_2$, and the UV output is set high in the irradiation area $A_3$. The setting values are temporarily stored in the RAM 42 or the storage unit 44 (hereinafter referred to as the RAM 42 or the like).

In step S120, the control unit 40 reads data on the patch images I described above in FIG. 5 from the RAM 42 or the like, and controls to print (eject) the patch images I from the head units 10 (inkjet heads 102) onto the transfer belt 20, and transport the recording medium P by the transport drum 24.

In step S130, the control unit 40 controls the output parameter of the first UV irradiation unit 25 according to the above-described setting condition at the timing when the patch images I on the transfer belt 20 come to the position of the first UV irradiation unit 25, and transports the recording medium P to the transfer nip NP to transfer the patch images I. By this processing, in the patch images I on the transfer belt 20, the patch images I (solid ink images in this example) corresponding to the irradiation area $A_1$, the irradiation area $A_2$, and the irradiation area $A_3$ have different viscosities. Specifically, the ink images corresponding to the irradiation area $A_1$ are cured to the lowest viscosity, the ink images corresponding to the irradiation area $A_2$ are cured to a medium viscosity, and the ink images corresponding to the irradiation area $A_3$ are cured to the highest viscosity. These ink images are pressed by the transfer nip NP at the transfer pressure according to the above setting condition, and transferred to the recording medium P as the four-color (YMCK) patch images I. The patch images I transferred to the recording medium P pass through a detection area of the density measurement sensor 30, and are subjected to the full-curing process by the second UV irradiation unit 26 (see step S50).

In step S140, the control unit 40 detects the ink densities of the patch images I after being transferred (pressed) to the recording medium P for each of the irradiation areas $A_1$ to $A_3$ and the colors (YMCK) of the patch images I, based on detection signals from the density measurement sensor 30. In this example, the control unit 40 detects twelve, that is, four colors×three areas ($A_1$ to $A_3$) ink density values (see FIG. 5). In one specific example, the control unit 40 determines the mean value of the ink density of one color and one area from the results of the ink density detection by the density measurement sensor 30, and detects the mean value for each of the twelve areas.

In step S150, the control unit 40 stores the detected ink density values (the mean value of each area in this example) in the RAM 42 or the like.

In step S160, the control unit 40 determines whether to perform process setting of the first UV irradiation unit 25 and the transfer pressure, according to whether a condition set by the user is satisfied.

Here, as one specific example of the "condition set by the user", it is set as a condition that it have been detected N times (N is a user setting value) that the ink density values of all the twelve areas of the patch images I (see the "density of ink image" in FIG. 4) stored in the RAM 42 or the like fall within an allowable range (see the "appropriate range" in FIG. 4).

Here, if the control unit 40 determines that it has not yet been detected N times (step S160, NO), the control unit 40 returns to step S110 and repeats the processing in steps S110 to S160 described above. In this case, in step S110 again, the control unit 40 estimates the UV irradiation condition (gradually increasing output value) and the transfer pressure of the transfer nip NP (constant value) at which the ink density values of all the twelve areas described above fall within the allowable range (appropriate range), and sets values based on the estimation results. The subsequent processing in steps S120 to S160 is the same as that described above.

If the ink density values of the twelve areas of the patch images I printed later do not fall within the allowable range (see the dotted line and the "appropriate range" in FIG. 4) despite M (M is a user setting value larger than N) executions of the processing in steps S110 to S150, the control unit 40 performs the following processing. In this case, the control unit 40 considers that the apparatus reaches the end of its life or has abnormality, and displays that fact and performs a display to urge the user to perform maintenance work by a serviceman or the like because deterioration of image quality printed in print jobs is expected.

Thus, if the control unit 40 determines that the condition set by the user is satisfied (step S160, YES), the control unit 40 proceeds to step S170.

In step S170, the control unit 40 sets actual printing process (printing setting) to the UV irradiation condition (the output value of the first UV irradiation unit 25) and the transfer pressure at which the density is the highest among the N detection results stored in the RAM 42 or the like, and completes a series of steps.

According to the present embodiment that performs the above-described processing, even if there are various factors and errors that affect the transfer rate, high transfer efficiency can be maintained without using a transferability improvement liquid or the like. Therefore, the inkjet image forming apparatus 1 of the present embodiment can maintain high transfer efficiency at low cost.

In the configuration example described above, the density measurement sensor 30 measures ink densities on the recording medium P to which ink images have been transferred through the transfer nip NP, and the control unit 40 estimates or determines transfer rates from the measurement results. As another configuration example, the density measurement sensor 30 may measure residual ink densities on the transfer belt 20 on the downstream side of the transfer nip NP, and the control unit 40 may estimate or determine transfer rates from the measurement results. In this case, the recording medium P used for transferring the patch images I may be of a material difficult to transfer. In this case, in step S170 described above, the control unit 40 may set the actual printing process (printing setting) to the UV irradiation condition (the output value of the first UV irradiation unit 25) and the transfer pressure at which the residual ink densities are the lowest among the N detection results stored in the RAM 42 or the like.

In the configuration example described above, for simplification, patch image patterns of one density (that is, only solid images with 100% density) are detected. As another example, patch image patterns of a plurality of densities (e.g., 75% and 50%) may be detected. In this case, more accurate transfer rates and thus output of the first UV irradiation unit 25 and transfer pressure suitable for various kinds of image data can be determined.

The above-described embodiment has described the case of using, as ink ejected from the inkjet heads 102, ink whose viscosity changes according to ultraviolet rays applied to the ink (UV light output from the first UV irradiation unit 25 and the second UV irradiation unit 26).

As another example, ink whose viscosity increases by irradiation with other active energy rays (e.g., electron beams) than UV light may be used. In this case, the first UV irradiation unit 25 and the second UV irradiation unit 26 may include an electron beam generation source that emits electron beams.

As another example, ink whose viscosity changes by change of the amount of heat supplied to the transfer belt 20 may be used. For example, ink that is gel at normal temperature and becomes sol by heating decreases in viscosity as it is heated. In this case, the first UV irradiation unit 25 and the second UV irradiation unit 26 may include a heating unit (heat source) such as a heater or a halogen lamp.

On the other hand, if ink containing water as a solvent is used, the water evaporates and the viscosity increases as the ink is heated. In this case, for the first UV irradiation unit 25 and the second UV irradiation unit 26, the above-described heating unit (heat source) or one that can control the transfer characteristics of an ink image by adjusting air-blowing temperature such as an air knife that produces an air flow (wind) for evaporating the water in the ink may be used. The first UV irradiation unit 25 and the second UV irradiation unit 26 are not limited to the above configurations as long as they can remove a solvent containing water in ink. As other examples, a member that brings a porous body into contact with an ink image to absorb a solvent containing water, a squeegee blade and roller that squeezes a solvent containing water out, etc. may be used.

In the configuration example described above, the setting values of the transfer conditions (i.e., the UV light amount from the first UV irradiation unit 25 and the transfer pressure) are changed to maximize the ink density and thus the transfer rate, but they may be set within a range that results in predetermined transfer efficiency or more (see the "appropriate range" in FIG. 4). Within that range, the setting values may be determined in relation to another function, for example. Here, another function may be, for example, the transfer rate of only black (K) in monochrome or gray scale printing, or a setting value focusing on color reproducibility or the like of a photographic image in full color printing.

Although embodiments of the present invention have been described and illustrated in detail, the disclosed embodiments are made for purposes of illustration and example only and not limitation. That is, the present invention can be implemented in various forms without departing from its scope or its major features. The scope of the present invention should be interpreted by terms of the appended claims.

What is claimed is:

1. An inkjet image forming apparatus, comprising:

a transfer part that transfers ink ejected from an inkjet head and carried on an intermediate transfer body to a recording medium; and a hardware processor that:

detects a transfer rate when the ink is transferred by the transfer part; and controls a control parameter that influences how the ink spreads when being transferred to the recording medium, according to the transfer rate detected by the hardware processor;

wherein the hardware processor detects the transfer rate from density of the ink transferred from the intermediate transfer body to the recording medium.

2. The inkjet image forming apparatus according to claim 1, wherein the hardware processor controls, as the control parameter, at least one of viscosity of the ink carried on the intermediate transfer body and a transfer condition of the transfer part.

3. The inkjet image forming apparatus according to claim 1, further comprising:

a viscosity adjuster that adjusts viscosity of the ink carried on the intermediate transfer body on an upstream side of the transfer part; and a transfer pressure adjuster that adjusts transfer pressure of the transfer part, wherein the hardware processor controls, as the control parameter, at least one of output of the viscosity adjuster or the transfer pressure of the transfer pressure adjuster.

4. The inkjet image forming apparatus according to claim 3, wherein the hardware processor controls the output of the viscosity adjuster such that a plurality of test patterns having different viscosities is carried on the intermediate transfer body, and the hardware processor detects the transfer rate of the ink constituting the test patterns.

5. The inkjet image forming apparatus according to claim 4, wherein the hardware processor detects the transfer rate of the ink transferred from the intermediate transfer body to a first recording medium, and the hardware processor controls the control parameter according to the transfer rate detected by the hardware processor such that the transfer rate of the ink transferred from the intermediate transfer body to a second recording medium exceeds a threshold value.

6. The inkjet image forming apparatus according to claim 1, wherein the hardware processor detects the transfer rate from density of residual ink on the intermediate transfer body on a downstream side of the transfer part.

7. The inkjet image forming apparatus according to claim 1, wherein the hardware processor comprises a density measurement sensor, and detects the transfer rate from density of the ink measured by the density measurement sensor.

8. The inkjet image forming apparatus according to claim 3, wherein the viscosity adjuster adjusts the viscosity of the ink by changing an amount of energy supplied to the intermediate transfer body.

9. The inkjet image forming apparatus according to claim 8, wherein the viscosity adjuster adjusts the viscosity of the ink by changing an amount of UV light applied to the intermediate transfer body.

10. The inkjet image forming apparatus according to claim 8, wherein the viscosity adjuster adjusts the viscosity of the ink by changing an amount of heat supplied to the intermediate transfer body.

11. The inkjet image forming apparatus according to claim 1, wherein the ink is ink that is thickened by supplying active energy rays.

12. The inkjet image forming apparatus according to claim 1, wherein the ink is ink containing water as a solvent.

13. The inkjet image forming apparatus according to claim 1, wherein the hardware processor executes control of the control parameter during a period when no print job is executed.

14. An image quality adjustment method in an inkjet image forming apparatus in which ink ejected from an inkjet head is carried on an intermediate transfer body and transferred to a recording medium by a transfer part, the method comprising:

detecting a transfer rate when the ink is transferred by the transfer part; and controlling a control parameter that influences how the ink spreads when being transferred to the recording medium, according to the detected transfer rate, wherein the hardware processor detects the transfer rate from density of the ink transferred from the intermediate transfer body to the recording medium.

* * * * *